US007808182B2

(12) United States Patent
New et al.

(10) Patent No.: US 7,808,182 B2
(45) Date of Patent: Oct. 5, 2010

(54) ELECTRON GUN AND MAGNETIC CIRCUIT FOR AN IMPROVED THZ ELECTROMAGNETIC SOURCE

(75) Inventors: David Arthur New, Mercerville, NJ (US); Robert Amantea, Manalapan, NJ (US); Peter James Coyle, Newtown, PA (US)

(73) Assignee: Sarnoff Corporation, Princton, NJ (US)

( * ) Notice: Subject to any disclaimer, the term of this patent is extended or adjusted under 35 U.S.C. 154(b) by 734 days.

(21) Appl. No.: 11/832,193

(22) Filed: Aug. 1, 2007

(65) Prior Publication Data

US 2008/0084153 A1 Apr. 10, 2008

Related U.S. Application Data

(60) Provisional application No. 60/834,727, filed on Aug. 1, 2006.

(51) Int. Cl.
*H01J 23/02* (2006.01)
*H01J 23/08* (2006.01)

(52) U.S. Cl. ..... 315/5.38; 315/5.35

(58) Field of Classification Search ..... 315/5.35, 315/5.38, 501; 335/296, 297, 298, 301
See application file for complete search history.

(56) References Cited

U.S. PATENT DOCUMENTS 3,408,627 A 10/1968 Kettler et al.
6,392,333 B1 * 5/2002 Veneklasen et al. ..... 313/361.1
6,777,877 B1 * 8/2004 Wright et al. ..... 315/5.35
6,870,318 B2 * 3/2005 Cascone et al. ..... 315/5.35
7,064,478 B2 6/2006 Azzi et al.
7,663,327 B2 * 2/2010 Bhatt et al. ..... 315/501
2006/0290452 A1 12/2006 Bhatt et al.

OTHER PUBLICATIONS

Joe et al., "Experimental and Theoretical Investigations of a Rectangular Grating Structure for Low-Voltage Traveling Wave Tube Amplifiers." 1997 American Institute of Physics.; Phys. Plasmas 4 (7) pp. 2707-2715 (Jul. 1997).
Sherwin et al., "Opportunities in THz Science." Report of a DOE-NSF-NIH Workshop held Feb. 12-14, 2004, Arlington, VA (Feb. 2004).
International Search Report for PCT/US2007/074979, dated Jul. 23, 2008.

* cited by examiner

*Primary Examiner*—Douglas W Owens
*Assistant Examiner*—Minh D A
(74) *Attorney, Agent, or Firm*—Lowenstein Sandler PC

(57) ABSTRACT

The present invention provides an enhanced THz electromagnetic source structure achieving a very high aspect ratio of 500 to 1 of electron beam width to electron beam thickness of the electron beam moving in the direction across the grating structure while maintaining its cross-section. The structure comprises a magnetic circuit providing a unique low magnetic field slot placed in a steel core for the placement of an electron gun, thus allowing the electron beam to be focused without the interaction of a magnetic field while still supporting a high magnetic field in the grating region. Additionally, the structure comprises an electrostatic shield preventing potential difference between the anode voltage and the grounded steel core from affecting the focusing of the electron beam.

10 Claims, 5 Drawing Sheets

ELECTRON GUN AND MAGNETIC CIRCUIT FOR AN IMPROVED THZ ELECTROMAGNETIC SOURCE

CROSS-REFERENCE TO RELATED APPLICATIONS

This application claims the benefit of U.S. Provisional Patent Application No. 60/834,727 filed Aug. 1, 2006, the entire disclosure of which is incorporated herein by reference.

GOVERNMENT RIGHTS IN THIS INVENTION

This invention was made with U.S. government support under contract number DEAC0494AL85000. The U.S. government has certain rights in this invention.

FIELD OF THE INVENTION

The present invention relates generally relates to a field of electromagnetic wave radiation technology and more particularly to an enhanced structure of electromagnetic wave radiation source at a Terahertz (THz) frequency.

BACKGROUND OF THE INVENTION

The passage of an electron beam over a metallic grating structure generates radiation that can be used in mm-wave and sub-mm-wave (Thz) spectroscopy. The grating structure is also known as a slow wave structure in which the electromagnetic field travels at a rate slower than the speed of light. The amount of radiation emitted is maximized by passing as high a current through an interaction region over the grating structure as possible. At a typical operating voltage (e.g., 5 kV) the depth of this interaction region is on the order of 10-20 microns high, while the width of the region is some significant fraction of the grating width (e.g., 10 mm or 1 cm), i.e. 1 cm by 20 microns. Thus a very high aspect ratio of 500 to 1 of beam width to beam thickness. Since only the portion of the electron beam passing through this interaction region contributes to the generation of radiation, for maximum efficiency the electron beam should feature roughly the same cross-section as the interaction region, i.e., the beam should be a ribbon beam that is several millimeters wide, with a constant beam height over the grating on the order of several tens of microns. This is in contrast to electron beams presently used for this purpose (interacting with a slow-wave structure), which are typically round and much larger than the interaction region.

In order to maintain a constant beam size over the grating, it is common for the grating to be placed in a magnetic field oriented in the same direction as the beam motion. A schematic of this is illustrated in conventional THz source 100 configuration in FIG. 1A. This field is typically on the order of 0.5 T in magnitude, and can be produced by rare-earth permanent magnets 102. The total beam current 104 emitted by the electron gun 106 is limited by the emission capabilities of the cathode and the size of the emitting area on the cathode. To maximize the amount of current in the electron beam 104 for a given cathode type, one wants to draw current from as large an emitting area as possible. One can then use electrostatic focusing to reduce the thickness of the beam 104 to the desired value over the grating structure 108. The limiting factor of this approach is the magnitude of the Larmor radius (rotations of the electrons in the beam) characteristic of the electrons in the beam as they move through the magnetic field in the grating region. The Larmor radius is $R_L=mv_r/qB$, where $mv_r$ is the transverse momentum of any given electron, v is for velocity, q is electric charge and B is the magnetic field. So while focusing can be used to reduce the beam size at the grating 108, too much focusing introduces excessive transverse momentum, leading to a large Larmor radius that will actually enlarge the beam size over the grating. This represents a tradeoff that can be optimized through a coordinated design of the electron gun and magnets, as described herein below.

The requirement that any electrostatic focusing introduce minimal transverse momentum to the electrons in the beam constrains the gun lens region to have a long focal length, and hence requires the gun 106 to be positioned a sufficient distance form the grating 108. In principle, the longer the focal length and greater the distance the gun 106 is from the granting 108, the smaller the beam 104 can be made at the grating structure 108. In practice, the displacement is limited by the constraints on the desired size of the device, and by emittance and space-charge considerations.

Thus, there is a need in the art to provide an improved electron gun and magnetic circuit, thereby improving the function and efficiency of an electromagnetic wave radiation source configuration and overcome the disadvantages of the prior art.

SUMMARY OF THE INVENTION

The present invention provides a THz electromagnetic source comprising a magnetic circuit comprising a steel core and a magnet. The steel core having a generally C-shape configuration with a first end connected to the magnet of a high magnetic region and a second end having a slot of low magnetic region. The source also comprises a grating region being positioned in a high magnetic region between the magnet and the second end of the steel core. The source further comprises an electron gun residing in the slot. The electron gun emits an electron beam traveling along a portion of the slot into the grating region. The source also comprises a first electrostatic shield plate (emitter electrode) electrically isolated from the steel core at the second end. The first shield plate substantially extending into the slot of the steel core. The source further comprises a second electrostatic shield plate (collector electrode) placed substantially in front of the magnet.

It is understood that the attached drawings are for the purpose of illustrating the concepts of the invention and may not be to scale.

DETAILED DESCRIPTION OF THE INVENTION

The present invention overcomes the disadvantages of the prior art as discussed above and provides an improved electron gun and magnetic circuit for electromagnetic wave radiation source configuration by achieving a very high aspect ratio electron beam (500 to 1) of beam width to beam thickness and maintaining this beam cross section while traversing the slow wave structure (the grating).

In one embodiment of the present invention, there is disclosed a magnetic circuit providing a unique low magnetic field slot placed in the iron core allowing the electron beam to be focused without the interaction of a magnetic field while still supporting a high magnetic field in the grating region.

In anther embodiment of the present invention, there is disclosed an electron gun with unique shaped electrodes with highly elongated apertures to control focus and shape of electron beam to achieve 500 to 1 aspect ratio of beam width to beam thickness.

In a further embodiment of the present invention, there is disclosed an electrostatic shield preventing potential difference between the anode voltage and the grounded steel core from affecting the focusing of the electron beam.

Each of the above embodiments is described in greater detail herein below.

Figure 1:
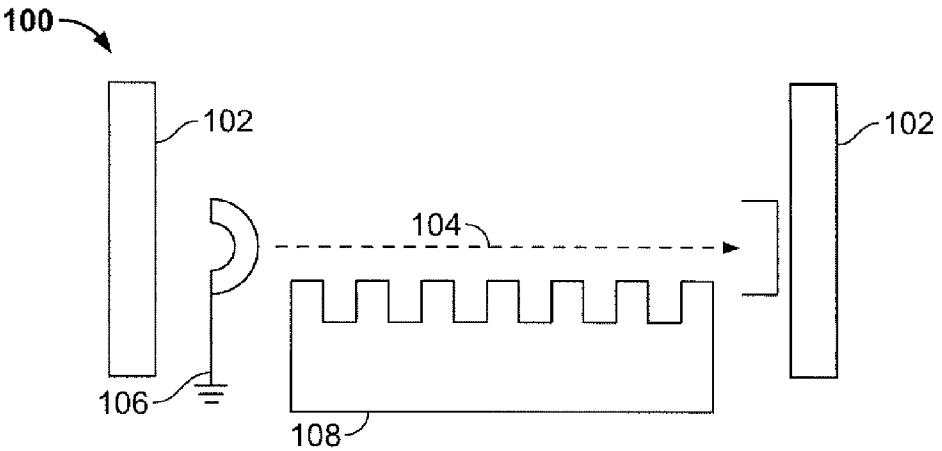
FIG. 1 (Prior Art)
FIG. 1 illustrates a prior art schematic configuration of a THz source.
Figure 2:
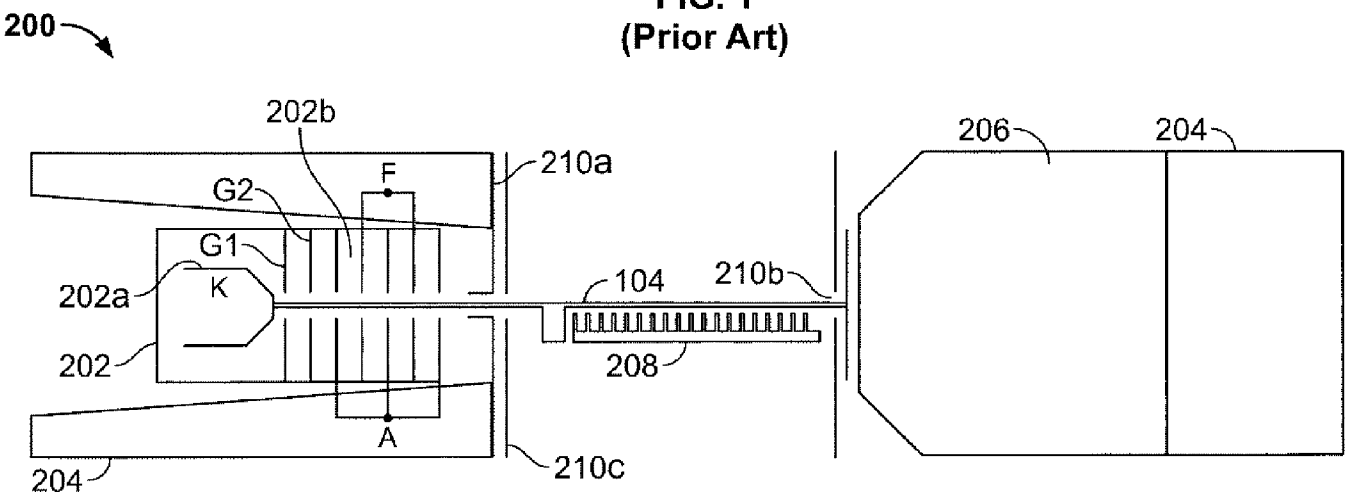
FIG. 2 illustrates a schematic circuit configuration of the THz source with electron gun and the magnetic circuit in accordance with an embodiment of the present invention.

Referring to FIG. 2, there is illustrated a schematic circuit configuration of the THz source device 200 having a combination of the electron gun and the magnetic circuit in accordance with the present invention. The source device 200 may also be referred as a Terahertz (THz) source device since the unit of electromagnetic (EM) wave frequency is measured in Terahertz. The source device 200 includes an electron gun 202 comprising a cathode plate 202*a* and electrodes 202*b*. The electron gun 202 resides in a slot in a high permeability steel core 204, which is attached to a very high density magnet 206. The details of this magnetic circuit design will be provided below with respect to FIGS. 3A and 3B.

Shield plate 210*a* (a.k.a. emitter electrode) extends from outside into part of the inside of the core 204 as shown in FIG. 2. Shield plate 210*b* (a.k.a. collector electrode) is located outside the shield magnet 206. Alternatively, another shield plate 210*c* is also added outside the core region. The electron beam 104 emitted from the cathode 202*a* passes through the electrodes 202*b* and into a grating region 208. At the other end of the source device 200, the electron beam 104 impinges on the collector electrode 212 as shown in FIG. 2. Note that grating region 208 may have a different structure from the one illustrated in the figures of the present invention.

Figure 3B:
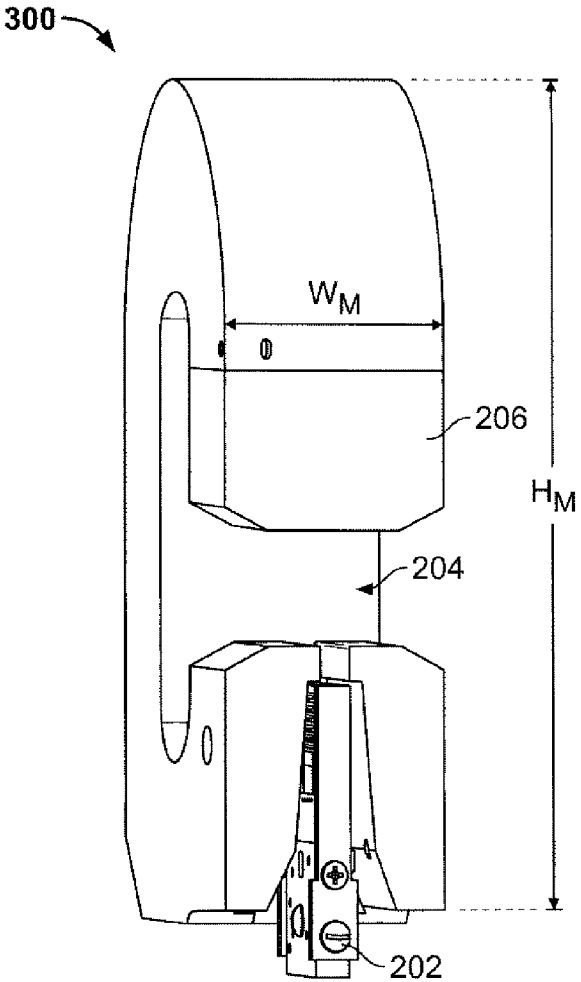
FIG. 3B illustrates a pictorial configuration of magnetic circuit design of FIG. 2 with the electron gun in accordance with the one embodiment of the present invention.
Figure 3A:
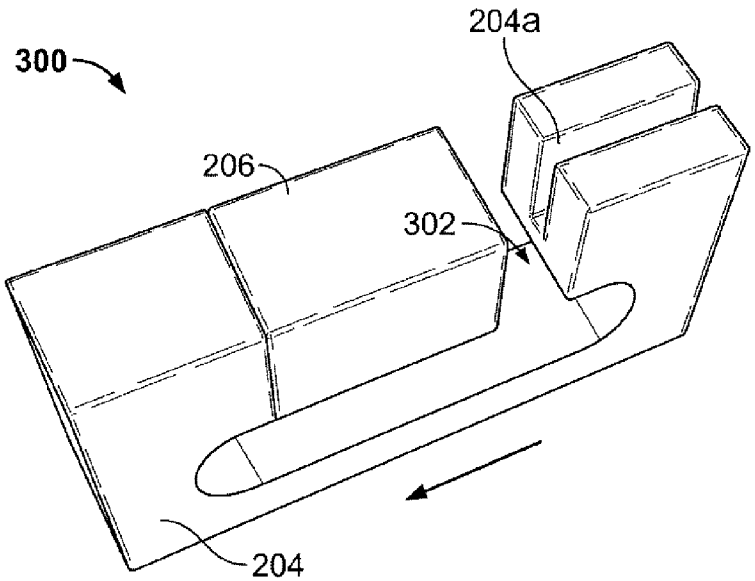
FIG. 3A illustrates a pictorial configuration of the magnetic circuit design of FIG. 2 without the electron gun in accordance with one embodiment of the present invention.

FIGS. 3A and 3B illustrates a pictorial configuration of the magnetic design 300 of the source device 200 in accordance with one embodiment of the present invention. The magnetic circuit deign 300 comprise a very high density magnet 206, preferably a Neodymium Iron Boron (NIB) magnet, the high permeability steel core 204 attached to the magnet 206. Note that the steel core 204 is illustrated as a generally C-shaped configuration. The source of the magnetic field is the magnet 206. Thus, the magnetic field travels from the side or portion of the steel core 204 attached to the magnet 206 around to the other side (i.e. end of the return path formed by the steel core 204) that faces across from the magnet 206. Thus, the magnetic field is also being conducted around the other side of the steel core 204. This side/portion of the steel core 204 facing opposite to the magnet 206 is also referred to as the first pole piece 204*a*. The magnet 206 is also referred to as the second pole piece 206*a*. There exits a field gap 302 between the first pole piece 204*a* and the second pole piece 206*a*. The magnetic field is very high in this field gap 302. The grating structure 208 (not shown) upon which the electron beam 104 travels is placed preferably in the center of the field gap 302. Also, shown is the direction of the electron beam 104 traveling from the first pole piece 204*a* to the second pole piece 206*b*.

Given that the electron gun 202 must be located some distance from the grating 208, and needs to reside in a region that is relatively free of magnetic fields, it is advantageous to have the gun 202 recessed into the first pole piece 204*a*. The first pole piece 204*a* of the steel core 204 includes a slot 204*b* having a low magnetic field. This unique structure of the core 204 allows to place the electron gun 202 inside the slot 204*b* as illustrated in FIG. 3B. So, in the present invention, actual focusing of the electron beam 104 can be performed in the lower (near zero) magnetic region in the slot 204*b* without the interaction of the magnetic field while still supporting a high magnetic field in the grating region 208. The electron beam 104 then exits the slot 204*b* to reach into the field gap 302 of high magnetic region. In this manner, if the exit of the gun 202 is recessed into the slot 204*b* by preferably 5 mm or more, the field experienced by the gun 200 is essentially zero. The field at the exit of the slot 204*b* is approximately 0.2 T, and achieves a value of 0.5 T at the grating location near the center of the field gap 302. This field strength is sufficient to maintain a relatively constant beam size.

Figures 2, 4A:
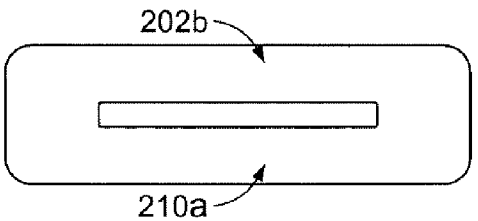
FIG. 4A illustrates a schematic configuration of an electron gun of FIG. 2 in accordance with one embodiment of the present invention.
Figures 3, 4A:
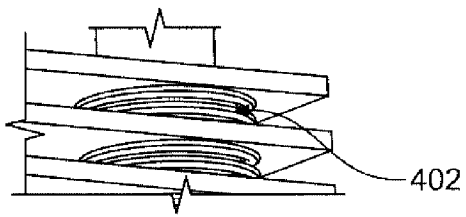
Figures 1, 4A:
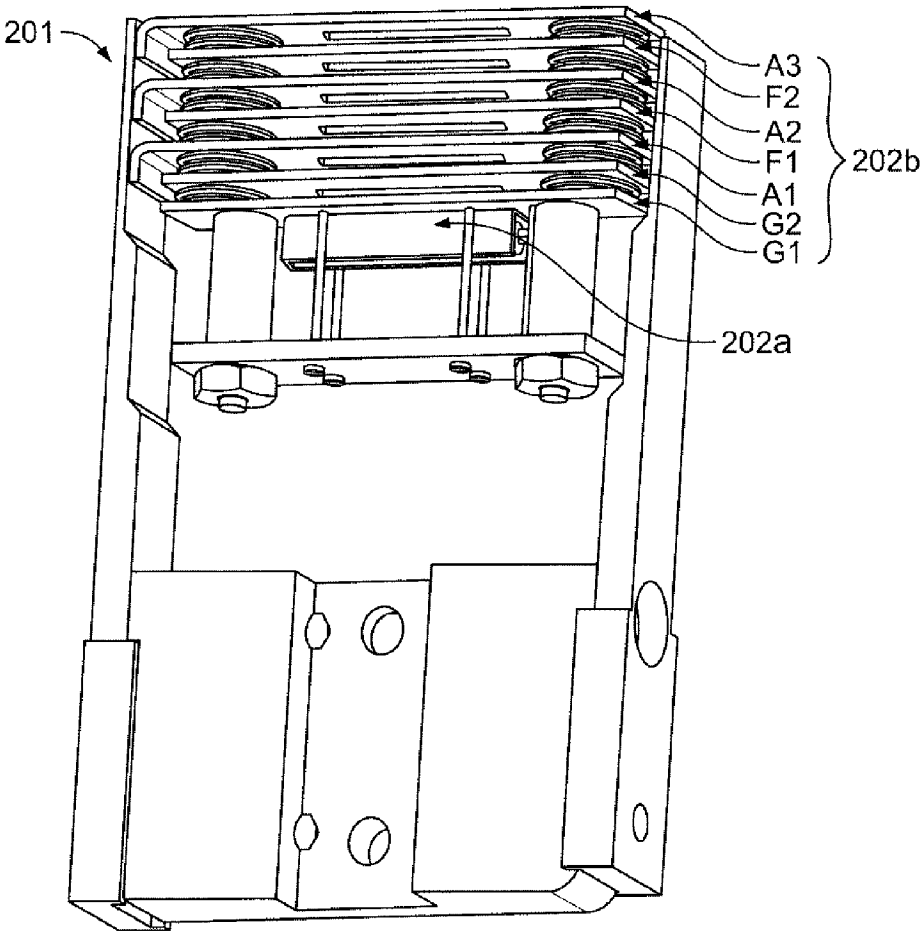

Referring to FIG. 4A of the present invention, there is shown a schematic configuration of the electron gun 202 of FIG. 2. The gun 202 generally comprises an anode 201, cathode 202*a* and a series of preferably seven electrodes 202*b*. The seven electrodes are labeled G1, G2, A1, F1, A2, F2, and A3 going away from the cathode, 202*a*. The first two electrodes, G1 and G2, control the amount of current in the beam. The next five electrodes A1, F1, A2, F2, and A3 form an electrostatic lens. These series of electrodes 202*b* are spaced apart by insulating apertures 402 as shown in FIG. 4A.

The electron gun 202 and applied voltages are designed so that the beam reaches the desired size at about the point the magnetic field has become significant. In the embodiment shown in FIGS. 4B and 4C, the beam size achieves the desired thickness, e.g., Full Width Half Max (FWHM) equal to 20 to 30 microns. (approximately at the exit of the slot 204*b* in the first pole piece 204*a* as will be described in detail below.

Figure 4B:
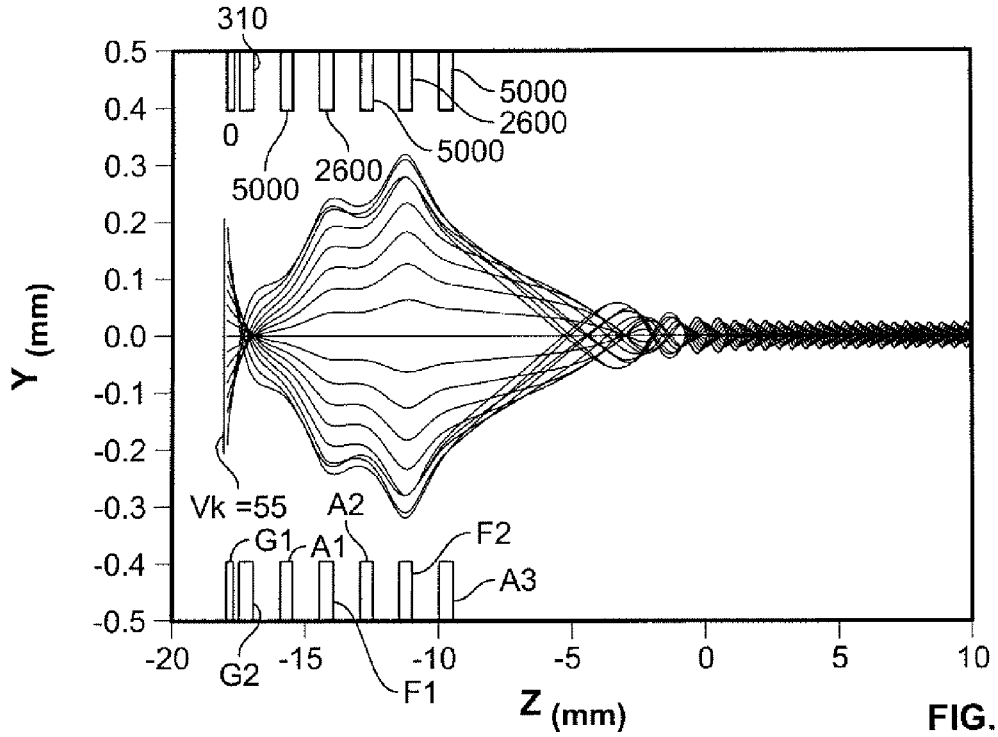
FIG. 4B illustrates a graphical representation of a cross-section of the electron gun of FIG. 4A to produce ribbon beam.
Figure 4C:
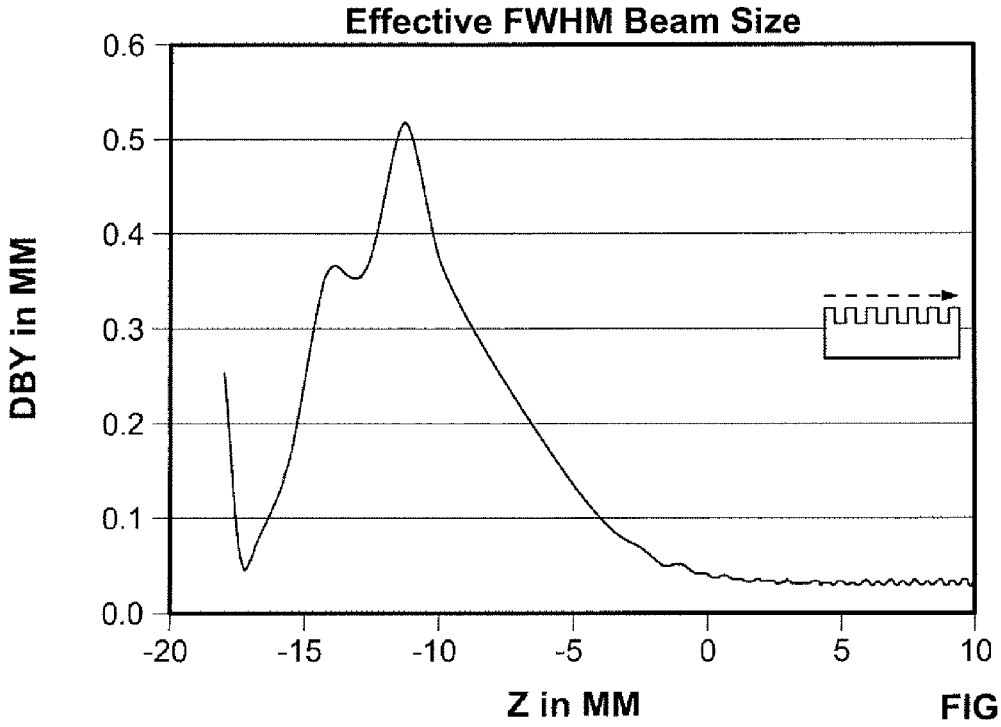
FIG. 4C illustrates a graphical representation of a variation of beam size of the electron gun of FIG. 4A.

Referring to FIG. 4B there is shown the focusing electrodes (A1, F1, A2, F2, & A3) of the gun 202 of FIG. 4A in a cross-sectional view, where the y-axis is in the direction normal to the grating 208 i.e., the direction corresponding to the small beam 104 and aperture dimensions and the x-axis is along the direction of beam motion. There is also shown a plot of the electron beam. The figure plot also includes representative electrode dimensions and voltages, and shows how the beam is focused down to a small size. This focusing takes place in a region where the magnetic field is relatively small, i.e. inside the slot 204*b*. The beam size achieves its desired value at the exit of the slot 204*b* where the z=0 in FIG. 3B and FIG. 3C. This desired value is the focal point of the beam. By the time the beam has reached the grating 208 (suggested by the icon in FIG. 3C), the magnetic field strength has increased to the point where it effectively stabilizes the beam 208 by keeping it focused throughout the grating region 208. The electrostatic lensing, however, has been made gentle enough that the Larmor radius, while visible in FIG. 4C as small oscillations in beam size, does not seriously degrade the beam size. Note that in FIG. 4C, the beam size is referred to as full width half maximum (FWHM) beam size as known in the art.

Figure 5A:
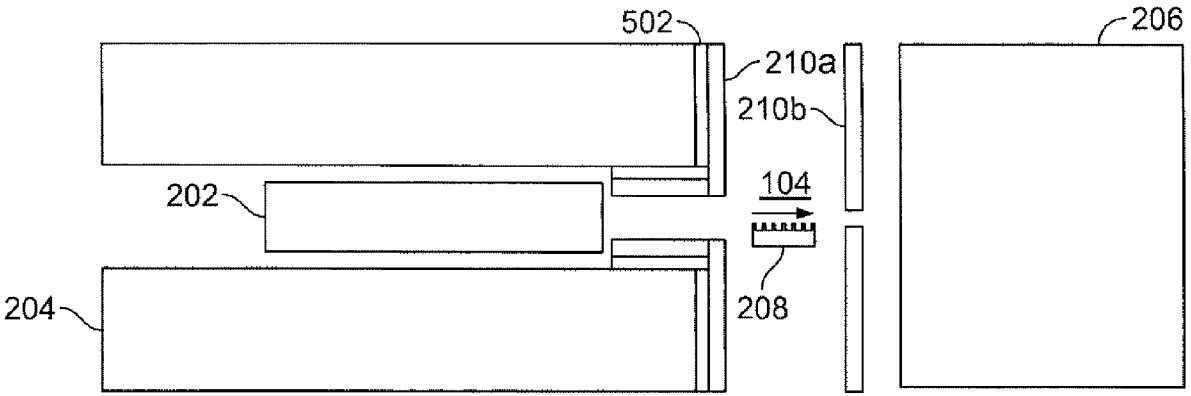
FIG. 5A illustrates a schematic cross-section configuration of the combined electron gun and magnetic circuit design of FIG. 2 with shield plates in accordance with another embodiment of the present invention.

In a further embodiment of the present invention, there is illustrated in FIG. 5A, a placement of the electrostatic shield 210 in the schematic cross-section configuration of the source device 200. Once the beam 104 exits the electron gun 202, it should be in a electric-field-free region containing the grating 208. This feature can be incorporated into the device using the shield plate 210*a* that is electrically isolated from the steel core 204 via a insulator 502, extends into the slot 204*a* of the steel core 204 to about the exit of the electron gun 202, and extend laterally along the face of the first pole piece 204*a*. This plate 210*a*, combined with an exit shield plate 210*b* located past the grating 208, creates an electrostatic-field-free region for the beam that extends from the gun 202 exit through the grating region 208. This is shown in cross-section in FIG. 5A. The shield plate 210*a* and the corresponding exit plate 210*b* are both preferably held at the same potential as the gun exit.

Note that even though the plates 210*a* and 210*b* creates an electrostatic-field-free region from the point that extends from the gun 202 exit through the grating region 208, there still exists a magnetic field in this region that keeps the beam focused. So, with this designing of the radiation source with the shield plate, the electrostatic field and the magnetic filed can be separated from one another, thus preventing the potential difference between the A3 electrode voltage and the grounded steel core 204 from affecting the focusing of the beam.

Figure 5B:
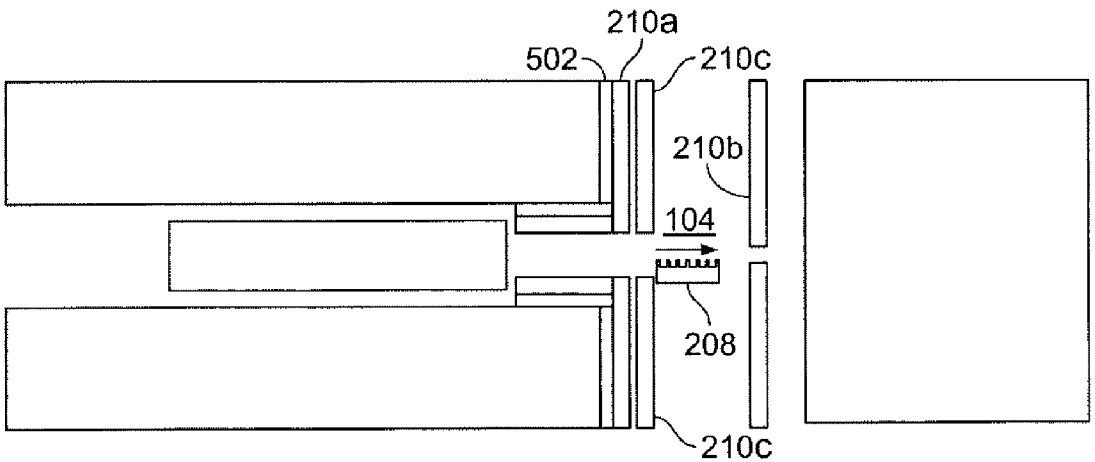
FIG. 5B illustrates a schematic cross-section configuration of the combined electron gun and magnetic circuit design of FIG. 2 with shield plate in accordance with alternate embodiment of the present invention.

Alternatively, as shown in FIG. 5B, another shielded electrode 210*c* is preferably added between the shield insert plate 210*a* and the grating 208 to allow the grating region 208 to be at a different potential from the last electrode in the electron gun 202. This allows the focusing of the beam to be adjusted independently from the final beam energy.

Even though various embodiments that incorporate the teachings of the present invention have been shown and described in detail herein, those skilled in the art can readily device many other varied embodiments that still incorporate these teachings without departing from the spirit and the scope of the invention.

The invention claimed is:

1. A THz electromagnetic source comprising:

a magnetic circuit comprising a steel core and a magnet, said steel core having a generally C-shaped configuration with a first end connected to the magnet of a high magnetic region and a second end having a slot of low magnetic region;

a grating region being positioned in a high magnetic region between the magnet and the second end of the steel core;

an electron gun residing in said slot; said electron gun emits an electron beam traveling along a portion of said slot into the grating region;

a first electrostatic shield plate electrically isolated from the steel core at the second end;

said first shield plate substantially extending into the slot of the steel core; and a second electrostatic shield plate placed substantially in front of said magnet.

2. The THz electromagnetic source of claim 1 wherein said electron gun having an entrance end and an exit end.

3. The THz electromagnetic source of claim 2 wherein said electron beam having a constant cross section throughout the grating region.

4. The THz electromagnetic source of claim 3 wherein said second electrostatic shield plate receives the electron beam upon exiting from the grating region.

5. The THz electromagnetic source of claim 4 wherein said first and second electrostatic shield plates create an electrostatic-field-free region for the electron beam, said electrostatic-field free region being positioned between the exit of the electron gun and the grating region.

6. The THz electromagnetic source of claim 1 further comprising a third electrostatic shield plate positioned between the first electrostatic shield and the grating region.

7. The THz electromagnetic source of claim 6 wherein said third electrostatic shield plate being constructed to control potential of the electron beam without affecting the focus of the electron beam.

8. The THz electromagnetic source of claim 1 wherein said electron gun comprising a cathode plate, a series of electrodes with elongated slits and spaced apart by insulators.

9. The THz electromagnetic source of claim 1 wherein said placement of the electron gun in the slot allows for the electron beam to be focused without interaction of the magnetic field while still supporting a high magnetic field in the grating region.

10. The THz electromagnetic source of claim 1 wherein width of the electron beam is about 1 cm and thickness of the electron beam is about 20 microns.

* * * * *